US005259467A

United States Patent [19]

Schoeffler

[11] Patent Number: 5,259,467

[45] Date of Patent: Nov. 9, 1993

[54] DIRECTIONAL DRILLING TOOL

[76] Inventor: William N. Schoeffler, 214 Carmel Dr., Lafayette, La. 70501

[21] Appl. No.: 865,835

[22] Filed: Apr. 9, 1992

[51] Int. Cl.[5] ..... E21B 7/08

[52] U.S. Cl. ..... 175/38; 175/73; 175/322

[58] Field of Search ..... 175/73, 24, 38, 61, 175/74, 256, 322

[56] References Cited

U.S. PATENT DOCUMENTS

| | | | |
|---|---|---|---|
| 4,655,289 | 4/1987 | Schoeffler | 166/320 |
| 4,655,299 | 4/1987 | Schoeffler | 175/38 |
| 4,811,798 | 3/1989 | Falgout, Sr. et al. | 175/73 |
| 4,895,214 | 1/1990 | Schoeffler | 175/38 |

FOREIGN PATENT DOCUMENTS

| | | | |
|---|---|---|---|
| 0969881 | 10/1982 | U.S.S.R. | 175/74 |

*Primary Examiner*—Terry Lee Melius
*Attorney, Agent, or Firm*—John D. Jeter

[57] ABSTRACT

A fluid powered incremental stepping motor arranged to serve as a length of pipe string has a body that includes an arbor end with an arbor of reduced diameter extending into a bore of a housing end bearingly supported for rotation about the arbor. An annular space between arbor and housing contains a piston rotationally secured to the arbor for limited axial movement. The piston operates within the bore as a power cylinder and carries a flow resistor. Fluid channels extend through the body to accept fluid flow down the pipe string. Fluid flow urges the piston downward and a spring urges it upward. Cams on each end of the piston and mating cams in the housing bore engage at the upward and at the downward extreme of piston travel and at each engagement impart an increment of rotation of the housing relative to the arbor at each excursion of the piston. Increasing fluid flow down the pipe string and then decreasing the flow causes the piston to reciprocate at each flow rate change cycle. The housing then is caused to rotate in steps as long as the flow rate cycling continues.

10 Claims, 2 Drawing Sheets

DIRECTIONAL DRILLING TOOL

This invention pertains to directional well drilling down hole tools. More particularly, but not in a limiting sense, the invention is used on drill strings that carry a fluid stream down hole through the drill string bore to lift cuttings from the hole and, in this case, to selectively orient the tool by selectively manipulating the flow of fluid moving down hole.

BACKGROUND OF THE INVENTION

Most wells drilled have some form of control of deflection, in the lateral direction, of the progressing drill head. A deliberate departure from a vertical direction is usually called directional drilling. The art of directional drilling has evolved to provide steering tools that enable drillers to observe at the surface indications of rotational orientation taking place down hole. Tools to deflect the progressing drill head from the existing well centerline can be simple but, if they are simple, they require rotational orientation and control of that orientation.

On a conventional drill string the rotational orientation of the down hole assembly may be done by manipulation of the drill string at the surface. If the drill string cannot be rotated, coiled pipe strings for example, the down hole assembly may need to be rotated relative to the drill string. There are other reasons to rotate one portion of the down hole assembly relative to another.

It is desirable for the driller to be able to rotate part of the down hole drilling assembly relative to another by actions taken at the surface in the form of selective manipulation of conventional drilling fluid flow controls.

It is therefore an object of this invention to provide apparatus to be part of the down hole drilling assembly that will respond to repeated increase and decrease of drilling fluid flow to progressively rotate drill string components below the apparatus relative to the drill string above the apparatus.

It is yet another object of this invention to provide apparatus that will resist the flow of drilling fluid and to utilize the flow related resistance to rotate a portion of the down hole assembly relative to another portion of the drill string a preselected amount each time the drilling fluid flow is changed between preselected amounts and to lock the rotating elements together when the drilling fluid flow is increased an additional preselected amount.

These and other objects, advantages, features of this invention will be apparent to those skilled in the art from a consideration of this specification, including the attached claims and appended drawings.

SUMMARY OF THE INVENTION

An incremental hydraulic stepping motor for rotating one end of a drill string relative to the other has a body bearingly mounted generally coaxially on an arbor for rotation of one end relative to the other end, each end adapted for attachment to continuing drill string elements. Channel means conducts fluid axially through the motor and, hence, between two elements of drill string connected by the motor. In an annular space provided between body and arbor a piston is situated, with a flow resistor to provide a pressure drop across the piston when fluid flows through the drill string. The piston is spring biased toward the flow source and is free to move toward the spring some distance at certain fluid flow rates and to move toward the flow source at lesser flow rates. At opposite ends of the piston cams are arranged to engage opposed cams on the body. The cams are axially arranged such that the piston has to be near one end of stroke before the cams at the opposite end of the piston can clear the opposed cams to rotate to provide a form of escapement mechanism.

The rotational relationship between mating sets of cams is such that when the piston reaches the limit of travel in one axial direction the mating cams at the opposite end have a rotational relationship such that axial movement of the piston toward the opposite limit of travel will cause the mating cams coming into engagement to continue the rotation of the body relative to the arbor in the same direction as provided by the previously engaged cam set. The piston moves axially when the flow of fluid down the drill string is manipulated between a preselected low flow rate and preselected higher flow rate. The fluid flow rate cycling and consequent rotary stepping of the overall motor can continue indefinitely. By preference, the round trip of the piston produces one-eighth turn, or otherwise stated eight complete flow rate cycles produce one turn of the motor.

For certain applications, an optional brake or one-way clutch is provided to prevent reverse rotation of the motor when the piston begins axial movement reversal. The clutch, if used, is situated in an annular space between arbor and body. Commercially available overrunning clutches can be used if space permits. On small diameter versions a well known helical coil spring clutch is suitable.

By design preference, the piston is splined to the arbor and drives the body in rotation. There is no fundamental difference if the piston is splined to the body and the opposed cams at each piston travel limit are each splined to the arbor.

BRIEF DESCRIPTION OF DRAWINGS

In the drawings wherein like captions represent similar features FIGS. 1A and 1B provide a side elevation, mostly in cut-away, of the preferred embodiment of the invention.

DETAILED DESCRIPTION OF DRAWINGS

Figure 1A:
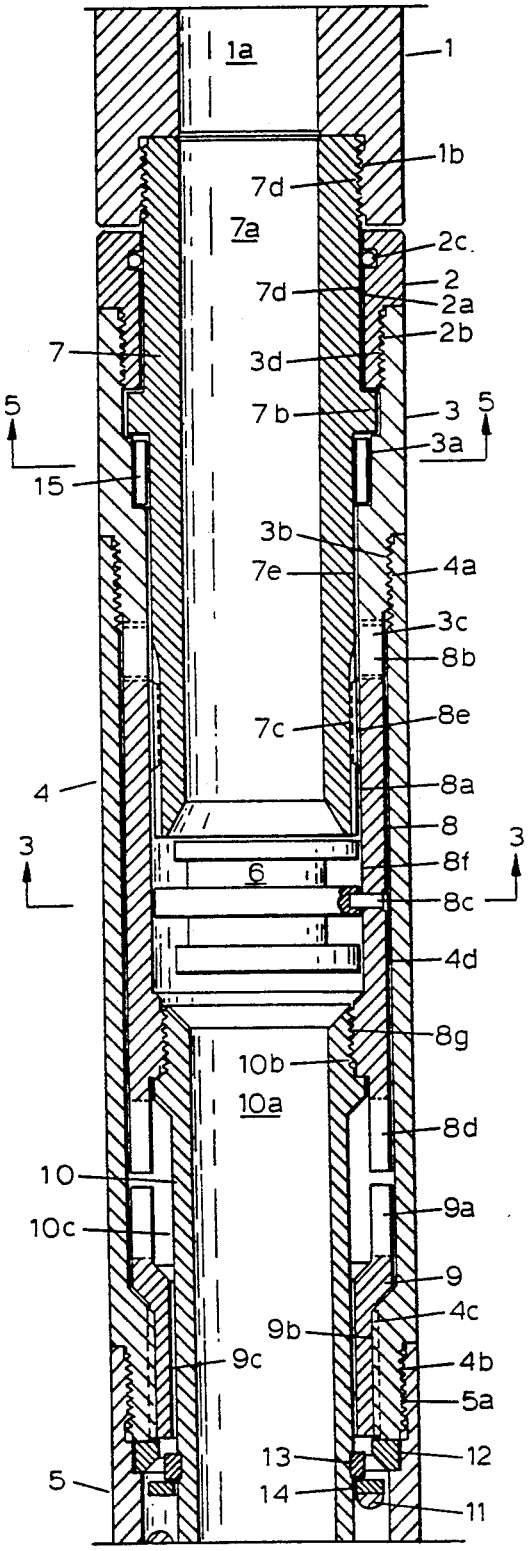
Figure 1B:
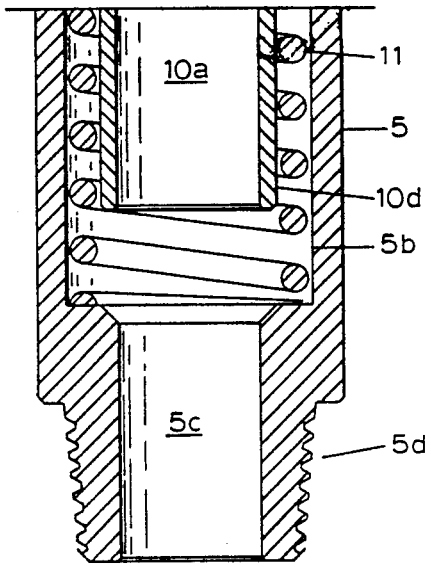

FIGS. 1A and 1B represent the preferred embodiment of the invention. In FIG. 1A member 1 has means (not shown) at the upper end for fluid tight attachment to an upwardly continuing pipe string component. Arbor 7 is threadedly attached by threads **7*d* engaging threads in bore 1*b*. Collar 2 carries seal 2*c* and is installed between member 1 and flange 7*b*. The seal engages cylindrical extension 7*d*. Retainer 3 is threadedly attached to collar 2 by threads 2*b* and 3*d* and captures flange 7*b*** to axially constrain the body in one assembly.

Retainer 3 has cams 3c peripherally distributed about the lower end. The cams will be described later herein. Piston housing 4 is threadedly attached to the retainer by threads 4a and 3b. Bore 4d contains close fitting piston 8 for axial movement therein. At the lower end, housing 4 has a reduced diameter with axially extending splines 4c peripherally distributed therein. Cam 9 has splines 9b arranged to mate with splines 4c. This allows cam 9 to be peripherally oriented within the housing for reasons to be described later herein. Cam 9 does not move axially after installation. Lower terminal 5 is threadedly attached to the housing 4 by threads 5a and 4b. Ring 12 is captured between housing and terminal and prevents downward movement of cam 9. Terminal 5, continuing in FIG. 1B, is finally provided with means for attachment to a downwardly continuing pipe string component and is optionally shown as a tool joint pin 5d.

Piston 8 has internal splines 8e peripherally distributed in bore 8a to rotationally engage mating axially extending splines 7c distributed about the arbor extension 7e. The piston moves axially along bore 4d but is rotationally secured to the arbor 7 and hence to the upwardly extending pipe string (not shown) attached to member 1. Flow restrictor 6 is secured in bore 8f by pin 8c. Washpipe 10 is threadely secured to the piston by threads 10b and 8g and extends downwardly along bore 5b. By way of captured ring 13 and washer 14 the washpipe engages spring 11 which rests on the bottom of bore 5b. Spring 11 applies an upward force to the washpipe and the piston to oppose the downward force applied to the piston when fluid flows downward through the restrictor. The piston upper end is exposed to the pressure above the restrictor because the outer surface of the piston and bore 4d provide the sealing effect needed and the outer surface 10c of the washpipe 10 and the bore 9c provide adequate clearance for the pressure below the washpipe to be exposed to the lower end of the piston.

When sufficient fluid flows downward through the channel means spring 11 will be compressed and the piston will move down to engage opposed cams 8d and 9a and release cams 8b and 3c. The channel means comprises bore 1a, bore 7a, the restrictor 6, bore 10a and bore 5c. The cams will be described later but the effect is to cause terminal 5 to rotate an incremental amount relative to member 1. When the fluid flow is reduced below a preselected amount, the spring 11 will return the piston upward to reverse the cam engagement and release feature to further rotate the terminal 5 relative to member 1 another incremental amount in the same direction. The flow change cycles and incremental rotation per cycle can be repeated indefinitely to rotate opposite ends of the pipe string any amount to satisfy the orientation purpose of the tool.

The use of the orienting motor generally requires a measurement-while-drilling (MWD) system. Such systems are not part of this invention but they have influenced the design. The restrictor, for instance, can be a simple orifice but wires or rods extending axially through the tool complicate the use of a central orifice. Restrictor 6 is adaptable to drilling for orienting devices of the users choice after consideration of the preferred system.

Unlike drilling motors, the orienting motor has little rotating life and is rarely under axial or bending stress while orienting action takes place. Bearing structure is not critical and the needed radial bearing surfaces are provided by cylindrical surfaces 7d and 7e. Thrust bearings must prevent tool separation for a pull on the downhole assembly but the orienting motor will be static during such pulls. Downward axial forces can be managed by flange 7b against retainer 3 but enough axial space can be provided to allow the top of collar 2 to engage the lower face of member 1. This stiffens the assembly while drilling.

Figure 2:
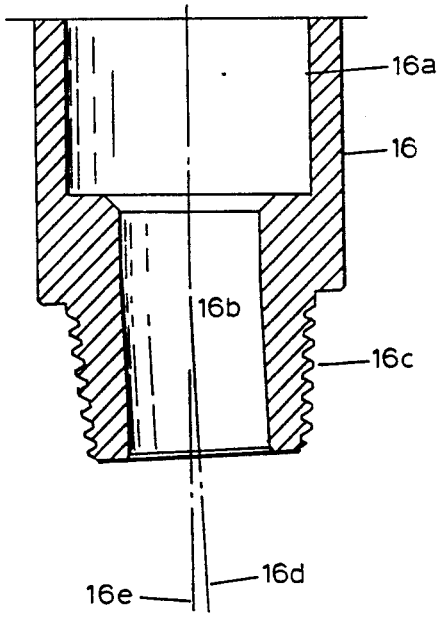
FIG. 2 is a side elevation, in cut-away, of an alternate lower terminal for the embodiment of FIG. 1.

FIG. 2 shows the incorporation of a bent tool joint on a terminal that can otherwise replace terminal 5. Rather than being structurally bent, the tool joint pin 16c is machined on centerline 16d which crosses the major tool centerline 16e at or near the face of the tool joint. This process is in the art and is referred to conventionally as a bent joint, normally on a sub connection two components of a pipe string. Bore 16b has the same function as the bore 5c. Bore 16a serves the same function as bore 5b.

Figure 3:
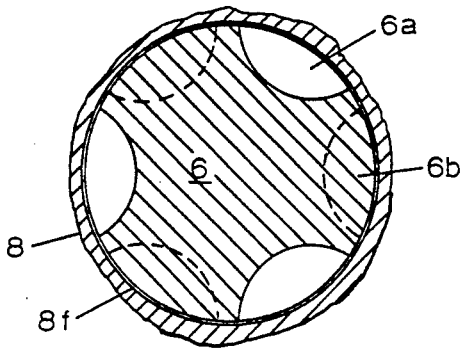
FIG. 3 is a sectional view of a component of the embodiment of FIG. 1 taken along line 3—3 of FIG. 4.
Figure 4:
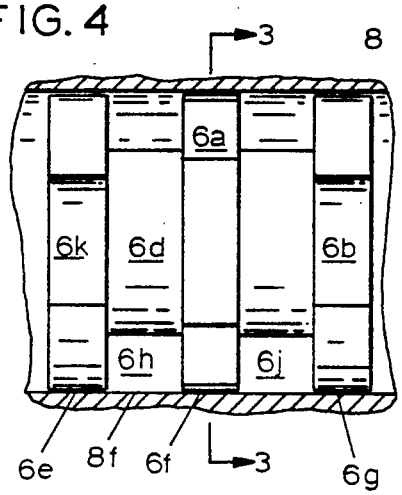
FIG. 4 is a side elevation of the component shown in FIG. 3.

FIGS. 3 and 4 show the restrictor 6 of FIG. 1A. This configuration may be called an impulse restrictor. Any number of flanges such as 6e, 6f, and 6g may be spaced axially by circular pockets such as 6h and 6j. Openings 6a, 6b, and 6k are rotationally out of registry with upstream openings and fluid moving through one opening is axially stopped, with consequent pressure drop, before proceeding through the next downstream opening. This accumulates piston effect forces and impulse forces directed downstream on the restrictor. Additionally, central mandrel 6d is available for drilling to accept MWD apparatus or related probes to relate the rotational relationship between upper and lower ends of the tool. If mud pulse MWD devices are used no drilling of the mandrel is required but the option exists. Such MWD apparatus is not part of this invention.

Figure 5:
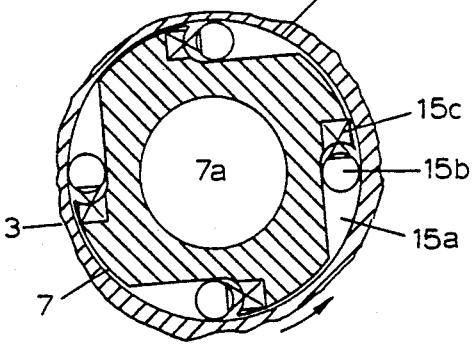
FIG. 5 is a cutaway of an optional feature for the embodiment of FIG. 1A taken along line 5—5.

FIG. 5 represents an optional one-way clutch. Such clutches are in the art and commercially available. This clutch has features machined directly into arbor 7. The pinch pockets 15a contain rollers 15b spring loaded by springs 15c into the pinch region. When retainer 3 rotates in the direction of the arrow the rollers have room to spin freely with little resistance to rotation. When the retainer tends to rotate in the opposite direction the rollers jam in the pinch dimension with little backlash and rotation is prevented. The surface of bore 3a is gripped by rollers.

Figure 6:
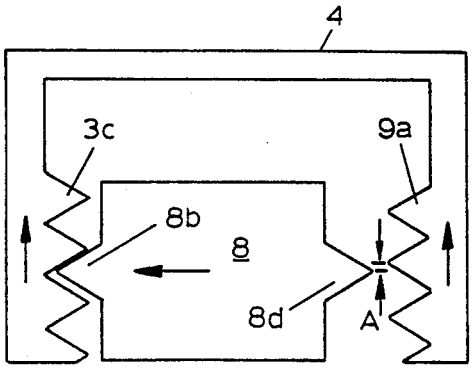
FIG. 6 is a development, mostly symbolic, describing cam operations in the embodiment of FIG. 1A.

FIG. 6 represents a modified development of the cam system. Symbolic piston 8 can move only axially as represented by the related arrow. Cams 3c and 9a are part of the symbolic housing 4 to which they are rotationally secured as an assembly (note FIG. 1A). They can only move rotationally and do so in the direction of the related arrows. Piston 8 is completing the upward excursion and is driving cams 3c in the direction of the arrow. Cams 9a can be positioned rotationally by splines 9b and 4c of FIG. 1A to have a position to provide misalignment A with the opposed cam points on cams 8d and 9a. When the piston moves downward and cams 9a are engaged by cam 8d, rotation of cam 9 and attached housing 4 will continue in the direction of the related arrows. The function described can be caused by one cam point on each end of piston 8 but for purposes of strength and durability piston 8 has a full complement of cam points, or fingers.

Figure 7:
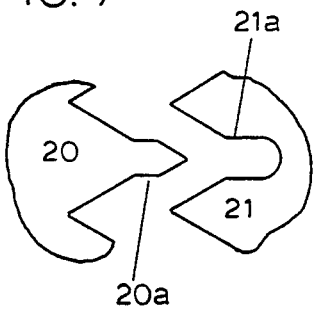
FIG. 7 is a plan view of an alternate form for selected cams of the embodiment of FIG. 1A.

FIG. 7 represents an optional configuration of the cam points 8d. This configuration rotationally locks the piston 8 and cam set 9 at the extreme travel of piston 8. Referring to FIG. 1A, cam shape 20 replaces cam shape 8d and cam shape 21 replaces cam 9a. The mating axially directed surfaces 20*a* and 21*a* prevent torque feed back from lifting the piston. The usual drilling assembly below the stepping motor contains a drilling motor which applies reverse torque to the assembly above the drilling motor. The configuration of cams of FIG. 7 prevent reverse torque from tending to lift piston 8. The upper cams 8*b* do not need special cam shape to resist torque because they engage cams 3*c* when fluid flow down the pipe string is reduced for stepping the motor and no drilling is taking place.

From the foregoing, it will be seen that this invention is one well adapted to attain all of the ends and objects hereinabove set forth, together with other advantages which are obvious and which are inherent to the methods and apparatus.

It will be understood that certain features and sub combinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1: A fluid powered rotary incremental stepping motor for use on pipe string bottom hole assemblies in well operations for rotary orientation of pipe string members, the motor comprising a body to function as a length of pipe string to connect an upper pipe string component to a lower pipe string component; channel means to conduct fluid between said pipe string components; swivel means arranged to allow relative rotation between opposite ends of said body; cam means within said body, movable therein and arranged to rotate one end of said body relative to the other end a preselected amount in response to a preselected amount of movement of said cam means; a flow restrictor in said channel means to resist fluid flow therethrough to produce a fluid pressure difference in response to flow of said fluid; a fluid power cylinder in said body arranged to move said cam means in response to changes in said pressure difference; and spring means in said body arranged to oppose said movement of said cam means whereby changing the flow rate from a preselected first flow rate to at least a preselected higher second flow rate and at least back to said preselected first flow rate causes one end of said body to rotate a preselected amount relative to the other end to rotate one of said components relative to the other said component;

wherein said body comprises an arbor end with means for fluid tight attachment to one said component, a housing end with means for fluid tight attachment to the other said component, said swivel means comprising bearing means for axial attachment, for rotation, of said body end relative to said arbor end, and seal means between said arbor end and said housing end to provide fluid tight integrity of said body;

wherein said cam means comprises an annular cam carrier situated in an annular opening between said arbor end and said housing end arranged for limited axial movement therein with cams extending in an axial direction from each end of said carrier, cam means in said housing end arranged to engage said cams on said carrier when said carrier approaches the end of the carrier travel limits to cause said housing end to rotate a preselected amount in one rotational direction when said carrier moves between said travel limits.

2. The motor of claim 1 wherein said carrier is carried by a splined arbor of reduced diameter extending into said housing end from said arbor end, said carrier having mating splines to rotationally secure it to said arbor extension for axial movement thereon.

3. The motor of claim 1 wherein said carrier is sealingly situated in a bore in said housing end to function as a fluid power piston therein, said flow restrictor carried in said carrier to provide said pressure difference across said carrier, said spring means being situated to apply force to said carrier in opposition to fluid pressure induced forces on said carrier when fluid flows through said body.

4. The motor of claim 1 wherein said cams on each end of said carrier comprise a peripherally distributed plurality of axially extending fingers tapered and opening away from said carrier with opposed cams carried by said housing end and arranged to interdigitate with cams on said carrier, the cams on said housing end axially spaced such that one set of cam fingers clear the opposed cams on said carrier when said carrier is at one travel limit, the rotational relationship between said cams on said housing such that cams being approached by the carrier cams will cause the housing end to continue rotation in the same direction caused by the cams previously engaged.

5. The motor of claim 1 wherein a one-way clutch is arranged said body to allow one end of said body to rotate in only one direction relative to the other end.

6. A fluid powered rotary incremental stepping motor for use on pipe string bottom hole assemblies in well operations for rotary orientation of part of the pipe string relative to another part of the pipe string, the motor comprising: a body adapted to function as a length of said pipe string with means at one end for attachment to an upwardly continuing portion of said pipe string, means at the other end for attachment to a downwardly continuing portion of said pipe string, with channel means to conduct a stream of fluid between said portions, said body comprising an arbor end and a housing end, said arbor end having an arbor of reduced diameter extending into a bore in said housing end to provide an annular opening extending axially therebetween, bearing means in said opening to axially constrain said two ends together for relative rotation therebetween, a cam carrier piston situated in said opening, rotationally secured to said arbor for axial movement thereon, closure means between said carrier and said arbor and between said carrier and the surface of said bore to enable said carrier to function as the piston of a power cylinder, a flow restrictor carried by said carrier to produce a pressure drop across said carrier when fluid flows through said channel means, spring means in said body arranged to urge said carrier to move in a direction opposite the direction of said fluid flow whereby said carrier is caused to reciprocate axially in said body in response to repeated cycles of flow increase and subsequent flow decrease through said body, cam means carried by said carrier arranged to engage cam means on said housing end such that at least part of the axial movement of said carrier causes said housing to rotate some amount in response to axial excursions of said carrier, said cam means comprising a first cam pair with one cam of said first pair carried by said carrier and the other of said first cam pair carried by said housing end and a second cam pair with one cam of said second cam pair carried by said carrier and the other cam of said second cam pair carried by said housing end, each said cam comprising a plurality of tapered fingers peripherally distributed about said opening, the cam pairs having opposed said fingers to engage with an interdigitating relationship, the rotational relationship between the cams on said housing such that when one cam pair leaves said interdigitating relationship the other pair of cams will approach each other such that cam surfaces on the approaching fingers will engage such that said housing end will be cammed into rotary movement in a preferred rotational direction.

7. The motor of claim 6 wherein a one-way clutch is provided in said opening arranged to permit rotation of said arbor end relative to said housing end in only one direction.

8. The motor of claim 6 wherein at least one of said closure means comprises clearances between cylindrical surfaces to control velocity of by-passed fluid.

9. The motor of claim 6 wherein one of said means for attachment to said continuing pipe string has a general centerline that crosses the general centerline of said body to provide a deflection of the general centerline of said pipe string.

10. The motor of claim 6 wherein said fingers on at least one of said cams comprises cam surfaces with at least two angles relative to the axial direction of said motor, at least one said angle generally parallel said axial direction, with a corresponding angle in the gaps between said fingers on the cooperating cam to prevent torque applied to said body by said pipe string from delivering axial forces to said carrier when said cam surfaces of said angle and cam surfaces of said corresponding angle are in contact.

* * * * *